United States Patent [19]

McIntire

[11] Patent Number: 4,614,435

[45] Date of Patent: Sep. 30, 1986

[54] MACHINE FOR MIXING SOLID PARTICLES WITH A FLUID COMPOSITION

[75] Inventor: William R. McIntire, Tulsa, Okla.

[73] Assignee: Dowell Schlumberger Incorporated, Tulsa, Okla.

[21] Appl. No.: 714,586

[22] Filed: Mar. 21, 1985

[51] Int. Cl.[4] ..... B01F 7/16; B28C 5/00

[52] U.S. Cl. ..... 366/40; 366/65; 366/164; 366/165; 366/263

[58] Field of Search ..... 366/150, 164, 165, 181, 366/263-265, 2, 6, 17, 33, 34, 35, 38, 169, 142, 65, 180, 177, 343, 183, 279, 293, 342, 10, 13, 40, 317

[56] References Cited

U.S. PATENT DOCUMENTS

| | | | |
|---|---|---|---|
| 3,147,957 | 9/1964 | Martin | 366/263 |
| 3,201,093 | 8/1965 | Smith | 366/167 |
| 3,326,536 | 6/1967 | Zingg | 366/17 |
| 3,423,075 | 1/1969 | Knudsen | 366/181 |
| 3,994,480 | 11/1976 | Fothergill | 366/165 |
| 4,239,396 | 12/1980 | Arribau | 366/65 |
| 4,453,829 | 6/1984 | Althouse | 366/40 |

*Primary Examiner*—Robert W. Jenkins

*Attorney, Agent, or Firm*—L. Wayne White; V. Dean Clausen

[57] ABSTRACT

The machine disclosed herein is useful for blending solids with fluids. In a typical operation, sand is mixed with a gel composition to obtain a fluid mixture suitable for stimulation treatments of oil and gas wells. The machine includes a slinger member, of a toroidal shape, and an impeller, of a vortex configuration, that is fastened underneath the slinger. In this machine entrained air is carried into the fluid phase by the sand, but the air is then "exhausted" from the sand-gel mixture thorough interior and exterior air exhaust channels and spaces that are built into the machine.

4 Claims, 3 Drawing Figures

MACHINE FOR MIXING SOLID PARTICLES WITH A FLUID COMPOSITION

BACKGROUND OF THE INVENTION

Broadly, the invention relates to a machine for continuously mixing solid particles with a fluid composition. More specifically, the machine is used as a blender in which sand or sand-like particles are mixed or blended with a gel composition, and the resulting slurry is pressurized by the blender itself. Typically, the slurry is used to treat a well in a petroleum recovery operation.

The blender machine described in U.S. Pat. No. 4,453,829 (Althouse) is typical of conventional blender machines now being used in oil or gas recovery operations. This machine has a slinger element of a toroidal configuration with a concave upper surface. Several upstanding blade members are mounted on the concave surface of this slinger and an impeller member is attached to the underside of the slinger. The slinger and the impeller are enclosed within a housing and fastened to the end of a drive shaft rotated by a motor mounted above the housing. A hopper is mounted above an inlet eye in the top of the housing, for introducing sand or other solid particles into the housing. At the bottom of the housing is a suction eye inlet, for drawing fluid into the housing, and the resulting fluid-solid mixture is discharged through an outlet port in the housing.

In the operation of the blending machine described above, sand flows out of the hopper in a continuous stream and drops onto the rotating slinger through the inlet eye in the housing. With the impeller and slinger rotating at the same speed, the vortex action of the impeller creates a suction force that draws the gel composition into the casing through the suction eye inlet. As the gel is pulled into the casing it is pressurized by the impeller and it mixes throughly with the sand being flung outwardly, in a centrifugal action, from the slinger. The sand-gel mixture is then continuously discharged, under pressure, through the outlet port, from which it is carried into a pumper unit and injected into a well.

The Althouse blender has a major drawback that makes it difficult for this machine to thoroughly mix a slurry of a particulate material, such as sand, and a fluid, such as a gel composition. The problem is caused by air in the sand, which becomes entrained in the fluid during the mixing operation. In a typical mixing operation, for example, the slinger and impeller may be rotated at speeds of up to 1,000 rpm. At these high speeds, the centrifugal action of the slinger causes the sand particles to move outwardly from the slinger into the whirling slurry mass that lies between the slinger-impeller units and the housing and below the impeller.

Centrifugal forces in the whirling slurry set up a radial pressure gradient, and since the density of air is much less than that of the slurry composition, the air is forced toward the center of the slurry mass. Therefore, any air that the sand carries below the upper edge of the slinger can't move outwardly against the pressure gradient and return to the area above the slinger. In other words, once the air moves downwardly from the slinger, it can't reverse its direction and "break out" of the slurry composition through the inlet eye at the top of the housing. Similarly, since the impeller increases in diameter as you move away from the slinger-impeller interface, air can't travel downwardly from the interface toward the underside of the impeller. Since the Althouse blender has no way to exhaust the air, it accumulates at the slinger-impeller interface. Because the slinger is larger in diameter than the impeller, the accumulated air "overflows" from the interface region into the region below the impeller. As a result, some of this air collects below the center of the impeller and forms an "eye". Since the impeller can't pump air, the Althouse blender rapidly loses its suction pressure and it ceases to pump the slurry mixture through the discharge outlet in the housing.

The present invention is based on a modification of the Althouse blender that solves the air entrainment problem. In the machine of this invention the entrained air in the slurry mixture can break out of the fluid phase through some interior and exterior air exhaust spaces and channels that are built into the modified blender structure.

SUMMARY OF THE INVENTION

The blending machine of this invention is designed particularly for mixing solid particles, such as sand, with a fluid composition, such as a gel. The solid particles are contained in a hopper mounted above the inlet eye of a housing member. The outlet end of the hopper sets above the inlet eye to provide an exterior air exhaust space at this point on the blender. The housing encloses a slinger and impeller member that is fastened to the underside surface of the slinger.

The impeller and slinger are both fastened to the bottom end of the drive shaft that extends up through the inlet eye of the housing to a motor that rotates the shaft. The slinger has a toroidal configuration and a topside concave surface that faces toward the top of the housing. The underside surface of the slinger has a recess in it and the recess defines an interior air exhaust space between the slinger and impeller. The slinger also has one or more interior air exhaust channels that extend from the air exhaust space between the slinger and impeller up to the topside surface of the slinger.

During the mixing operation the sand particles carry air into the fluid composition and this air becomes entrained in the fluid phase of the sand-gel mixture. The entrained air is carried out of the mixture through the interior air exhaust space, the interior air exhaust channel, and the exterior air exhaust space.

DESCRIPTION OF THE INVENTION

Figure 1:
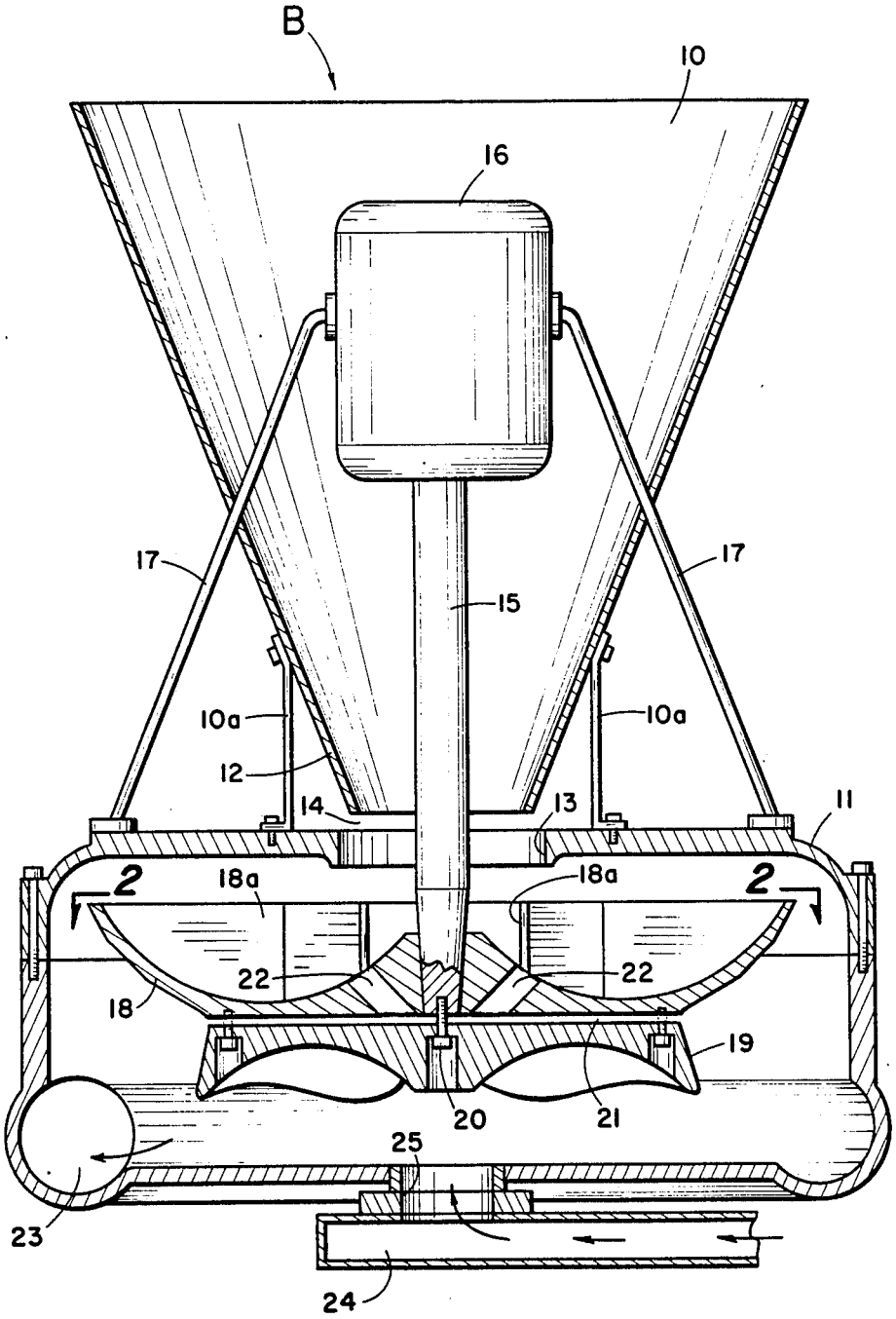
FIG. 1 is a front elevation view, mostly in section, of one embodiment of the blender machine of this invention.
Figure 2:
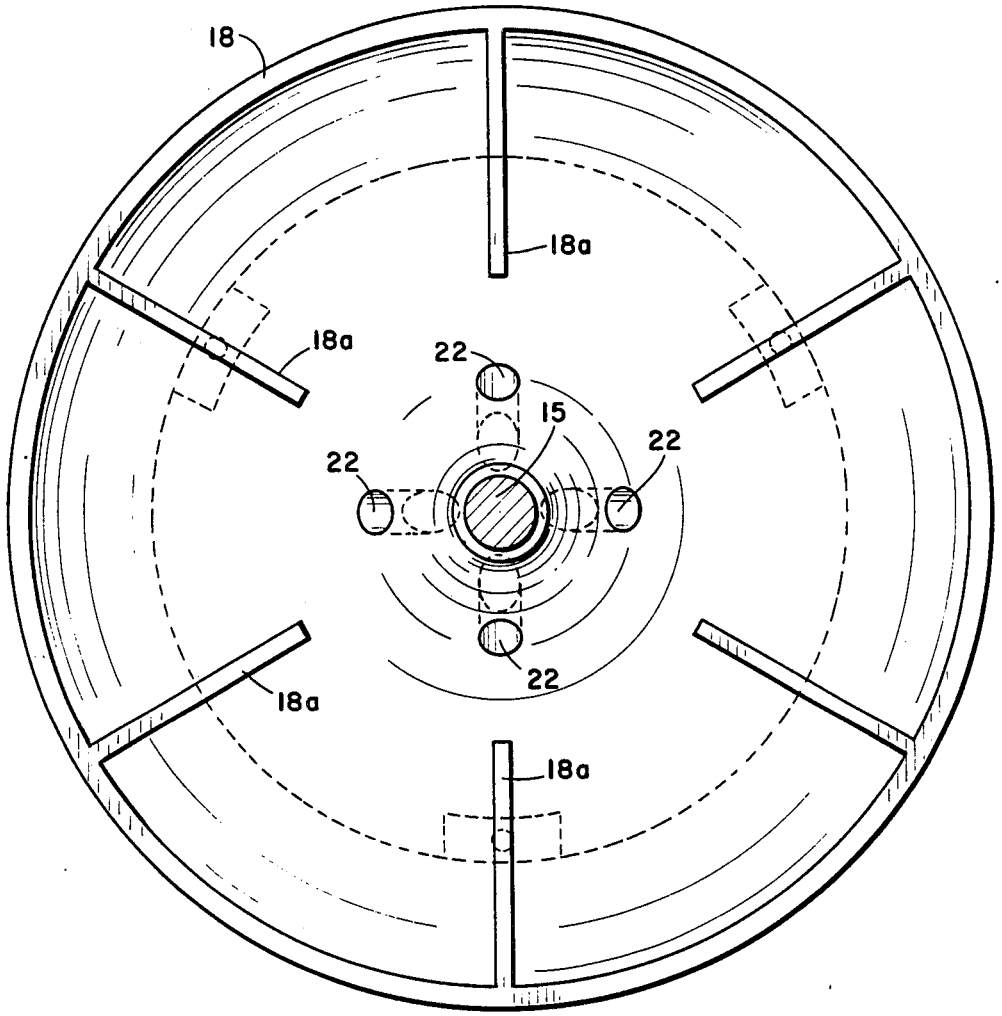
FIG. 2 is a plan view of the slinger component of the blender machine, as taken on line 2—2.

One embodiment of the blender machine of this invention is illustrated in FIG. 1. In FIG. 1 the blender machine is generally indicated by the letter B. At the top of the blender is a hopper 10, that provides a container for solid particles, such as sand (not shown). In this embodiment the hopper 10 is mounted on the top side of a housing 11 and held in place by supports 10*a*. As illustrated, the bottom end of the hopper, which is the outlet end 12, terminates just above inlet eye 13 in housing 11. Sand or other solids from the hopper are dropped into the housing through the inlet eye. Positioning the outlet end 12 just above the inlet eye 13 provides an exterior air exhaust space 14 between the hopper and the inlet eye.

A drive shaft 15 is positioned inside the hopper 10, such that the bottom of the shaft extends through the inlet eye 13 and into housing 11. The shaft is driven by a motor 16 at the top end of the shaft. The motor is supported by rods 17 that are fastened into the housing 11. The mixer elements of the blender machine consist of a slinger member 18 and an impeller member 19. The impeller is secured to the bottom end of drive shaft 15 by a bolt fastener 20. The underside surface of the slinger has a recess therein, so that when the impeller 19 is fastened to the slinger an interior air exhaust space 21 is defined between the underside surface of the slinger member and the topside surface of the impeller.

Slinger 18 has a central opening therein (not shown) that allows it to fit over the bottom end of the drive shaft 15 above the bolt fastener 20. The slinger has a toroidal configuration, including a concave surface that faces toward the top of the housing 11. The slinger also includes some air exhaust channels 22, that extend diagonally through the body of the slinger. One end of each channel communicates with the interior air exhaust space 21, and the opposite end defines an opening along the concave surface of the slinger. The impeller has a vortex configuration, with a concave surface which faces toward the bottom of the housing.

In the embodiment illustrated in FIG. 1, the topside concave surface of slinger 18 is interrupted by several upstanding blade members 18*a*. Housing 11 encloses the slinger 18 and impeller 19, and the housing includes an outlet port 23, for discharging material from the housing. One end of an inlet conduit 24 is connected into the housing 11 and the opposite end of the conduit is connected into a source for a fluid composition, such as a gel. During the mixing operation the fluid composition is drawn into the housing 11 through the inlet conduit 24 and a suction-eye inlet 25 at the bottom of the housing 11.

Operation

In a typical operation of the blender machine of this invention, sand is mixed with a gel composition to obtain a fluid mixture suitable for injecting into an earth fracture to stimulate recovery of oil or gas. At the start of the mixing operation, the motor 16 rotates the drive shaft 15, slinger 18, and impeller 19. With the slinger and impeller in motion, a desired amount of sand is dropped into hopper 10, so that it flows in a continuous stream through the inlet eye 13 and drops onto the rotating slinger 19. As the sand drops onto the slinger, it is propelled outwardly into the housing 11. With the vortex impeller rotating at the same speed as the slinger, the vortex action of the impeller creates a suction force inside the housing, and this force pulls the gel composition into the housing through the suction-eye inlet 25.

As the gel is pulled into the housing 11, it is pressurized by the impeller and it interfaces with the sand being flung outwardly from slinger 18. The result is a thorough mixing of the solid-gel composition, which is continuosly discharged under pressure through the outlet port 23. From port 23 the sand-gel mixture is carried into a pumper unit, for injection into a wellhead and down the borehole. The pumper unit, the well head, and the borehole are not illustrated in the drawing.

As described earlier, air trapped in the sand particles is carried into the fluid phase during the mixing operation. But, in the practice of this invention the interior air exhaust space 21, and the interior air exhaust channels 22, along with the exterior air exhaust space 14, allow the air to escape from the fluid phase, rather than becoming entrained in the fluid.

Figure 3:
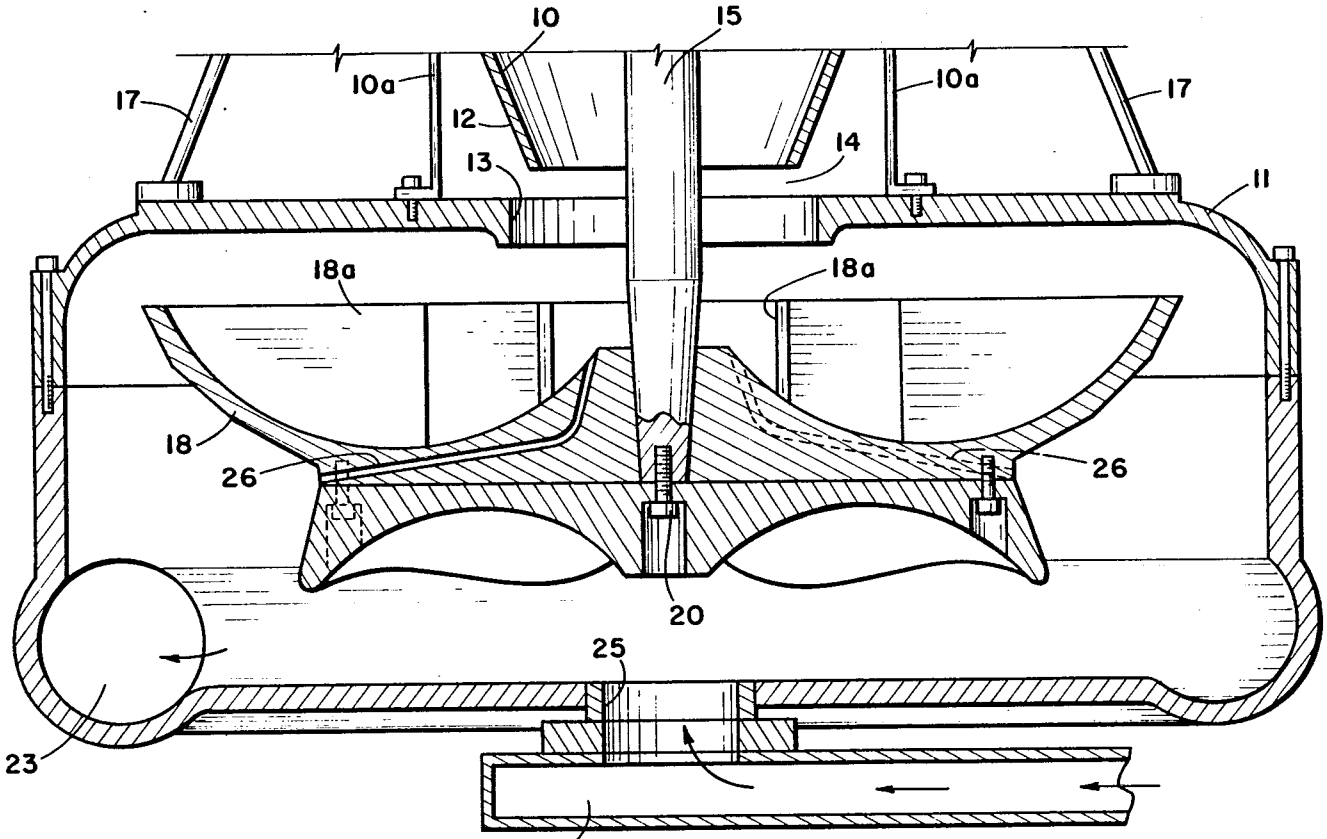
FIG. 3 is a partial front elevation view, mostly in section, of the second embodiment of the blender machine of this invention.

Looking now at FIG. 3, this embodiment of the blender machine is identical to that shown in FIG. 1, except for the air exhaust means that is built into this structure. In FIGS. 1 and 3, therefore, the same reference numerals are used to identify the same parts in each of these blender structures. In the structure illustrated in FIG. 3 an interior air exhaust means is provided by one or more air exhaust channels 26. The lower end of each channel 26 is located on the periphery of the slinger 18 near the juncture of the slinger and impeller 19. The opposite, or upper end of each channel, is located on the topside concave surface of the impeller near the center of the surface. In operation, therefore, the air that is carried into the fluid phase by the sand is carried upwardly through the channels 26 and is "exhausted" through the inlet eye 13 and the exterior air exhaust space 14. In the practice of this invention, one air exhaust channel 26 may be used, but better results are obtained by providing two or more of these channels in the blender structure.

Since the blender machine of this invention is a modification of the Althouse blender, as described in U.S. Pat. No. 4,453,829, the general teachings of this patent are incorporated by reference into the present specification.

The invention claimed is:

1. A machine for mixing solid particles with a fluid composition, which includes means for exhausting entrained air from the mixture of solid particles and fluid, the machine comprises:

a hopper for containing the solid particles, the hopper has an outlet end that terminates above the inlet eye of a housing member, so that an exterior air exhaust space is defined between the hopper outlet end and the housing inlet eye;

a drive shaft that extends into the housing through the inlet eye;

a slinger member that is fastened to the drive shaft, the slinger member has a toroidal configuration, the slinger member has a topside concave surface that faces toward the top of the housing and an underside surface with a recess therein;

the topside surface of the slinger member is interrupted by several blade members, the depth of each blade is the linear distance from the upper edge to the lowest point of each blade, the linear distance between the said upper edge of each blade member and the nearest opposite point on the flat surface of the housing defines a positive gap between the slinger member and the housing, and the linear distance of said positive gap is in the range of from about one-half the depth of each blade to about twice the depth of each blade;

an impeller member that is fastened to the underside surface of the slinger member and to the drive shaft, so that the recess in the slinger member defines an interior air exhaust space between the underside surface of the slinger member and the topside surface of the impeller member;

the slinger member includes at least one interior air exhaust channel that extends from the interior air exhaust space to the topside surface of the slinger member;

the impeller member has a vortex configuration, including an underside concave surface that faces toward the bottom of the casing;

the slinger member has a larger surface area than the impeller member;

the slinger and impeller members are enclosed by the housing and these members are rotatable inside the housing;

a drive means for rotating the drive shaft, the slinger member, and the impeller member;

an inlet conduit having one end in communication with the housing, and the opposite end in communication with a source for the fluid composition;

an outlet port in the housing for discharging a mixture of the solid particles and fluid composition from the housing;

wherein, during mixing of the fluid composition and the solid particles inside the housing, air that is entrained in the mixture is carried out of the mixture through the interior air exhaust space, the interior air exhaust channel, and the exterior air exhaust space.

2. The machine of claim 1 in which the slinger member includes at least four air exhaust channels, and each channel extends from the interior air exhaust space to the topside surface of the slinger member.

3. A machine for mixing solid particles with a fluid composition, which includes means for exhausting entrained air from the mixture of solid particles and fluid, the machine comprises:

a hopper for containing the solid particles, the hopper has an outlet end that terminates above the inlet eye of a housing member, so that an exterior air exhaust space is defined between the hopper outlet end and the housing inlet eye;

a drive shaft that extends into the housing through the inlet eye;

a slinger member that is fastened to the drive shaft, the slinger member has a toroidal configuration, the slinger member has a topside concave surface that faces toward the top of the housing and an underside surface with a recess therein;

the topside surface of the slinger member is interrupted by several blade members, the depth of each blade is the linear distance from the upper edge to the lowest point of each blade, the linear distance between the said upper edge of each blade member and the nearest opposite point on the flat surface of the housing defines a positive gap between the slinger member and the housing, and the linear distance of said positive gap is in the range of from about one-half the depth of each blade to about twice the depth of each blade;

an impeller member that is fastened to the underside surface of the slinger member and to the drive shaft;

the slinger member includes at least one interior air exhaust channel having a lower end and an upper end, the lower end is located on the periphery of the slinger member near the juncture of the slinger member and impeller member, and the upper end is located on the topside concave surface near the center of the slinger member;

the impeller member has a vortex configuration, including an underside concave surface that faces toward the bottom of the casing;

the slinger member has a larger surface area than the impeller member;

the slinger and impeller members are enclosed by the housing and these members are rotatable inside the housing;

a drive means for rotating the drive shaft, the slinger member, and the impeller member;

an inlet conduit having one end in communication with the housing, and the opposite end in communication with a source for the fluid composition;

an outlet port in the housing for discharging a mixture of the solid particles and fluid composition from the housing;

wherein, during mixing of the fluid composition and the solid particles inside the housing, air that is entrained in the mixture is carried out of the mixture through the interior air exhaust space, the interior air exhaust channel, and the exterior air exhaust space.

4. The machine of claim 3 in which the slinger member includes at least four interior air exhaust channels, each air exhaust channel has a lower end and an upper end, the lower end is located on the periphery of the slinger member near the juncture of the slinger member and impeller member, and the upper end is located on the topside concave surface near the center of the slinger member.

* * * * *